US007409286B2

(12) United States Patent
Ambort

(10) Patent No.: US 7,409,286 B2
(45) Date of Patent: Aug. 5, 2008

(54) APPLICATION FOR DIMINISHING OR AVOIDING THE UNWANTED EFFECTS OF TRAFFIC CONGESTION

(76) Inventor: Jorge Osvaldo Ambort, Hallwylstrasse 64, Zurich, Zurich (CH) 8004

( * ) Notice: Subject to any disclaimer, the term of this patent is extended or adjusted under 35 U.S.C. 154(b) by 0 days.

(21) Appl. No.: 10/177,268

(22) Filed: Jun. 24, 2002

(65) Prior Publication Data

US 2003/0236612 A1 Dec. 25, 2003

(51) Int. Cl.
*G08G 1/07* (2006.01)
*G08G 1/00* (2006.01)

(52) U.S. Cl. ..... 701/117; 340/916; 340/923; 340/932; 340/907; 340/909; 104/88.02

(58) Field of Classification Search ..... 701/117, 701/118; 340/907, 909, 816, 923, 932; 104/88.02
See application file for complete search history.

(56) References Cited

U.S. PATENT DOCUMENTS

| | | | | |
|---|---|---|---|---|
| 2,007,801 | A * | 7/1935 | Halvorson | 340/932 |
| 2,219,310 | A * | 10/1940 | Haugh, Jr. | 340/923 |
| 4,370,718 | A * | 1/1983 | Chasek | 701/117 |
| 5,050,161 | A * | 9/1991 | Golestani | 370/230 |
| 5,999,877 | A * | 12/1999 | Takahashi et al. | 701/117 |
| 6,191,705 | B1 * | 2/2001 | Oomen et al. | 235/384 |
| 6,304,816 | B1 * | 10/2001 | Berstis | 701/117 |
| 6,317,058 | B1 * | 11/2001 | Lemelson et al. | 340/910 |
| 6,318,274 | B1 * | 11/2001 | Park | 104/88.02 |
| 6,393,360 | B1 * | 5/2002 | Ma | 701/208 |
| 6,405,132 | B1 * | 6/2002 | Breed et al. | 701/301 |
| 6,466,862 | B1 * | 10/2002 | DeKock et al. | 701/117 |
| 6,489,920 | B1 * | 12/2002 | Anders et al. | 342/179 |
| 6,556,916 | B2 * | 4/2003 | Waite et al. | 701/117 |
| 6,574,548 | B2 * | 6/2003 | DeKock et al. | 701/117 |
| 6,587,778 | B2 * | 7/2003 | Stallard et al. | 701/117 |
| 6,633,238 | B2 * | 10/2003 | Lemelson et al. | 340/909 |

(Continued)

FOREIGN PATENT DOCUMENTS

CN 1110419 A * 10/1995

(Continued)

OTHER PUBLICATIONS

Vehicular traffic jam control, Castrucci, P.; Godoy, R.; Latin America Transactions, IEEE (Revista IEEE America Latina) vol. 4, Issue 1, Mar. 2006 pp. 21-26.*

(Continued)

*Primary Examiner*—Cuong Nguyen

(57) ABSTRACT

A process to interchange the "stop and go" driving behaviour of the traffic with a "stop and wait, then go later without stopping" driving behaviour, consisting on a partitioning of the congested route in segments through pre-installed stop and go signals marking the limit of segments to give a stop to the vehicles of the first part and later another stop to the vehicles of the second part of the divided congestion and so on, to permit the liberation of the front conflict part of the way, turning the first signal to go at the appropriate moment and then turning the second signal to go and so forth until the vehicles of every segment after waiting in standstill go without stopping re-stabilizing the normal traffic flow. The waiting time will be announced simultaneously to avoid the uncertainty of waiting time.

2 Claims, 3 Drawing Sheets

U.S. PATENT DOCUMENTS

| | | | | |
|---|---|---|---|---|
| 6,668,729 | B1 * | 12/2003 | Richards | 104/124 |
| 2003/0236612 | A1 * | 12/2003 | Ambort | 701/117 |

FOREIGN PATENT DOCUMENTS

| | | | | |
|---|---|---|---|---|
| EP | 591150 | B1 | * | 1/1999 |
| JP | 2000097065 | A | * | 4/2000 |
| JP | 2000153752 | A | * | 6/2000 |
| WO | WO 9108628 | A | * | 6/1991 |

OTHER PUBLICATIONS

Freeway traffic surveillance and control, Isaksen, L.; Payne, H.J.; Proceedings of the IEEE, vol. 61, Issue 5, May 1973 pp. 526-536.*

Dynamical Model of Traffic Congestion with the Consideration of the Next-nearest- neighbor Interaction, Zhipeng Li; Xiaobo Gong; Yuncai Liu; Intelligent Control and Automation, 2006. WCICA 2006. The Sixth World Congress on, vol. 2, Jun. 21-23, 2006 pp. 8697-8701, Digital Object Identifier 10.1109/WCICA.2006.1713679.*

Automated highway system—Considerations for success, Saxton, L.; Vehicular Technology Conference, 1980. 30th IEEE vol. 30, Sep. 15-17, 1980 pp. 423-430.*

A taxonomy for congestion control algorithms in packet switching networks, Cui-Qing Yang; Reddy, A.V.S.; Network, IEEE vol. 9, Issue 4, Jul.-Aug. 1995 pp. 34-45, Digital Object Identifier 10.1109/65.397042.*

Nonlinear optimization for freeway control using variable-speed signaling, Alessandri, A.; di Febbraro, A.; Ferrara, A.; Punta, E.; Vehicular Technology, IEEE Transactions on, vol. 48, Issue 6, Nov. 1999 pp. 2042-2052, Digital Object Identifier 10.1109/25.806796.*

A qualitative model of cross-lane inhomogeneities in traffic flow, Wei Guan; Intelligent Transportation Systems, IEEE Transactions on, vol. 5, Issue 3, Sep. 2004 pp. 188-199 , Digital Object Identifier 10.1109/TITS.2004.833760.*

A Cumulative Momentum Concept for the Enhancement of Traffic Management, Chung Yu; Muir, S.; SoutheastCon, 2004. Proceedings. IEEE, Mar. 26-29, 2004 pp. 12-19, Digital Object Identifier 10.1109/SECON.2004.1287892.*

Effective delay control for high rate heterogeneous real-time flows, Weijia Jia; Hanxing Wang; Maoning Tang; Wei Zhao; Distributed Computing Systems, 2003. Proceedings. 23rd International Conference on, May 19-22, 2003 pp. 367-375 Digital Object Identifier 10.1109/ICDCS.2003.1203486.*

Highway traffic surveillance and control research, Carter, A.A., Jr.; Hess, J.W.; Hodgkins, E.A.; Raus, J.; Proceedings of the IEEE, vol. 56, Issue 4, Apr. 1968 pp. 566-576.*

Traffic flow theory, Gazis, D.C.; Edie, L.C.; Proceedings of the IEEE, vol. 56, Issue 4, Apr. 1968 pp. 458-471.*

Advanced traffic management in California, Roper, D.H.; Endo, G.; Vehicular Technology, IEEE Transactions on, vol. 40, Issue 1, Part 2, Feb. 1991 pp. 152-158, Digital Object Identifier 10.1109/25.69983.*

* cited by examiner

APPLICATION FOR DIMINISHING OR AVOIDING THE UNWANTED EFFECTS OF TRAFFIC CONGESTION

Traffic congestions occur mainly through lack of consideration for the driver from the traffic authorities.

At present the existing process to diminish or avoid traffic jams by diverting the traffic to less congested roads proves to be absolutely ineffective. Main reason is the lack of alternative routes, for example at border crossings, on motorways or construction sites for repairing purposes.

Processes, influencing the speed of the vehicle (alternating signals suggesting adequate speed limits) are methods highly depending on the driver respecting them. It is a fact, that alternative routes and deviations as well as speed limit suggestions mentioned above can not be safely manipulated.

The presented application's main priority is to avoid the "stop and go" driving behaviour. Highest fuel consumption and concentrated gas emissions are the negative effects of such behaviour.

This new application takes closer consideration of travel time as well as length of traffic jam. The drivers are confronted with one single driving behaviour and one single route only.

Travelling through a congested area depends highly on the "stop and go" driving behaviour of each driver. The amount of time used by vehicles to pass a traffic jam is the key issue of this claim for patent.

a) Amount of time used by each individual vehicle x in a "stop and go" driving behaviour

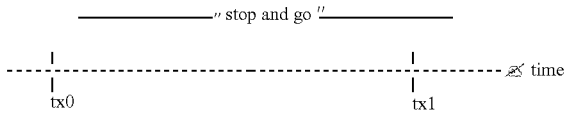

(x = vehicle x)

b) Newly defined travelling time

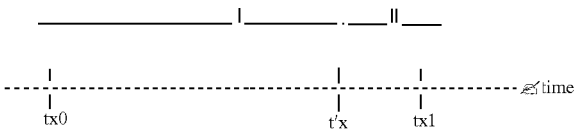

I) Time without motion ("Stop and wait . . . )

II) Time for normal driving ( . . . then go later without stopping."

The main target of the inventor is to interchange the "stop and go" driving behaviour with a "stop and wait, then go later without stopping" driving behaviour. This includes the treatment of time.

The treatment of space or area occupied for the traffic jams is based on a continues backward movement of the traffic congestion, meaning a movement towards the area of less traffic.

The Main Task of the Application is as Follows

After the source of congestion has been located (examples are: a road work area on the motorway, which is going to be present for a number of months or a boarder crossing with seasonal congestion or maybe a well known area for accidents etc.) a sensor signal communication system is installed (FIG. 1) For accidents the application requires a light system with easy positionable elements.

Figure 1:
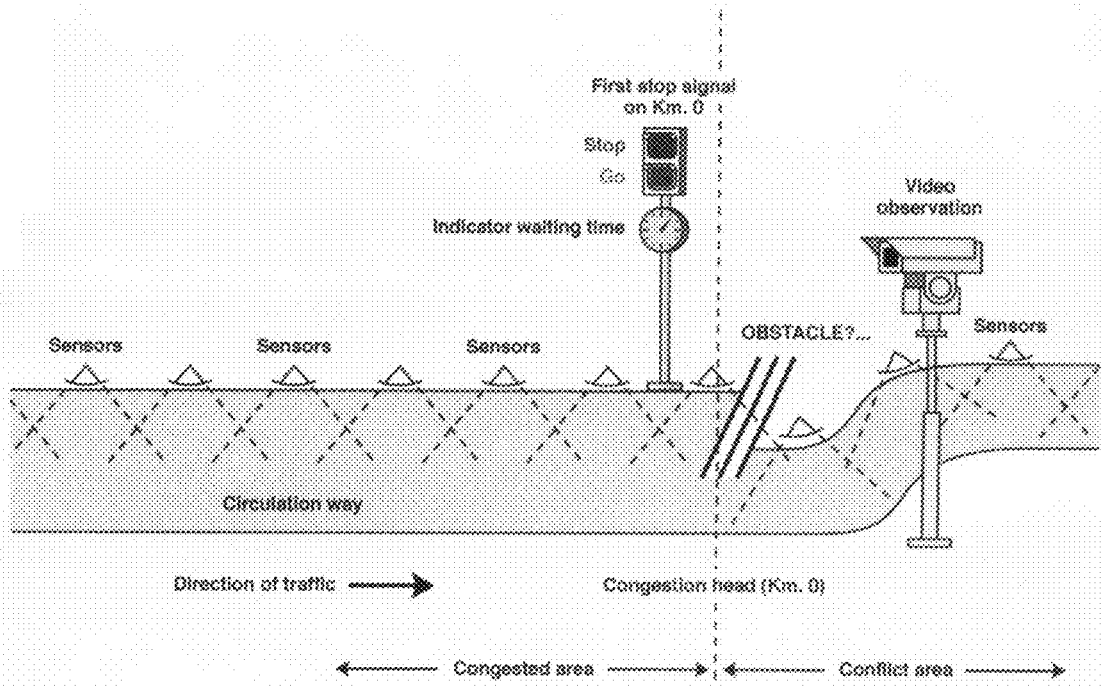
FIG. 1 shows a schematic segment of circulation's way with the installation of detectors, signals and the waiting time indicator according to the present invention.

A so called congestion head is defined for each situation through the system or a video surveillance. The sensors which are installed in the forward area of the congestion head detect the expected liberation of the critical road parts (FIG. 1)

Further sensors, located backward from the congestion head detect the gradual and later on total standstill of the vehicles and subsequently the following liberation of the critical road part.

The congested area is divided into smaller sections. The length of each section depends on the driving behaviour and the geography of the congested area. For normal traffic jams due to road works the section length is somewhere around 100 metres.

For the above example every 100 metres a signal is installed at the boundary of each section showing either a "stop" or "go" display.

Every section has sensors detecting either a standstill or flowing of traffic in the sensitive areas. They will however not detect the speed of the traffic.

The Method

The traffic jam is detected as soon as a particular area shows the "stop and go" driving behaviour. This means, a certain amount of vehicles have gone through a temporary standstill and the sensors have determined the congestion head. The congestion head is usually just preceding the actual cause of the congestion.

The first 200-300 metres of congestion are surveyed. It is also possible to survey a shorter distance of "stop and go" driving behaviour, but research has shown, that the actual duration of a traffic jam gets shorter the earlier it gets detected and measures are taken.

As soon as an actual traffic congestion has been detected, the first stop signal preceding the congestion head is activated. The sensors in between will detect a liberation of the conflict area. Meanwhile further sections one after the other get affected by the situation and the vehicles slowly stop down one by one.

The sensors inform the central computer and it will activate the next stop signal for the second section and so on.

Figure 2:
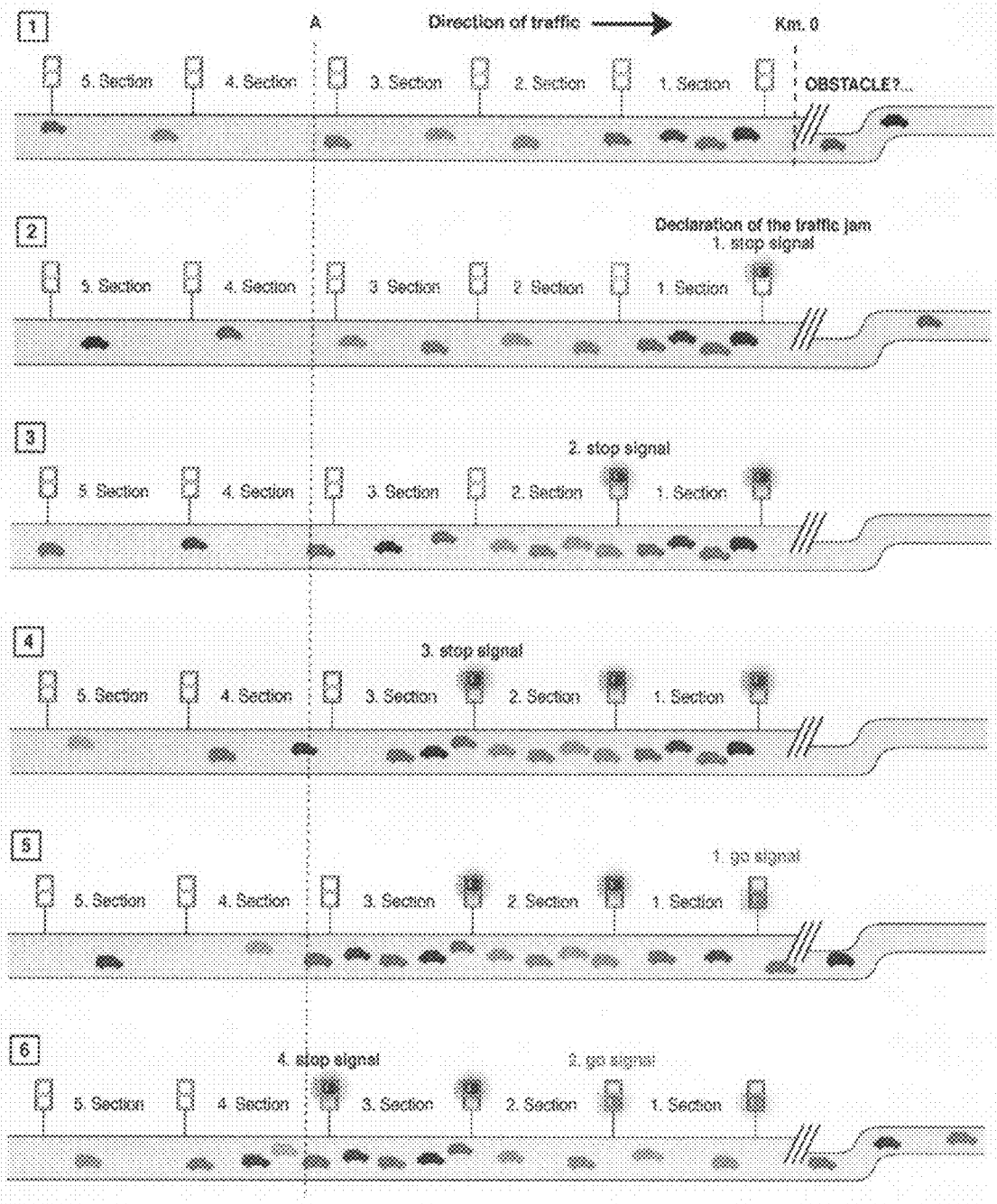
FIG. 2 shows a sequence of 6 instant pictures of a congestion area, where the declaration of the traffic jam and the application's process will take place according to the present invention.
Figure 3:
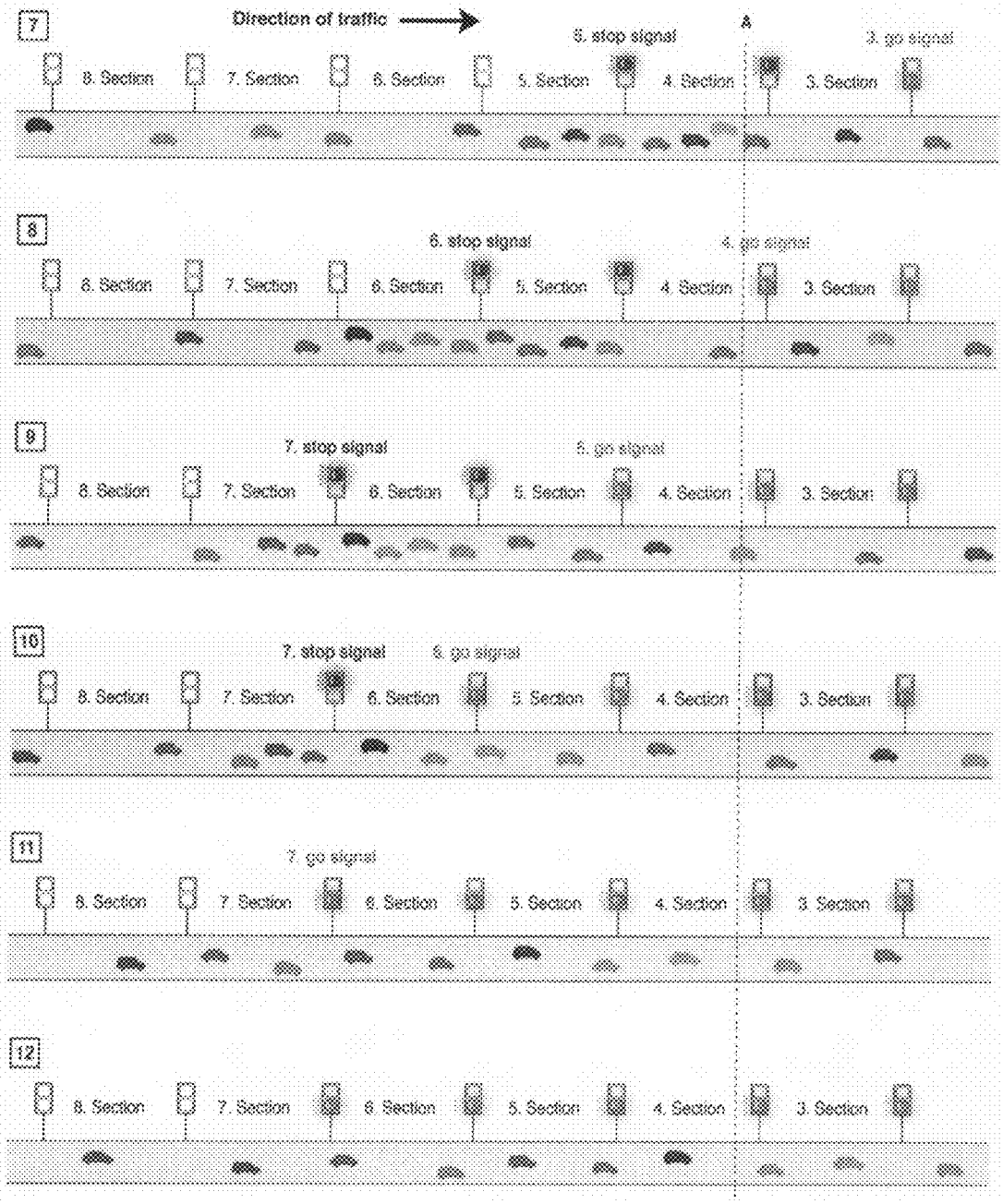
FIG. 3 shows the continuation sequences until the end of the process.

Meanwhile the conflict area has been liberated and therefore the signal for the first section turns green and vehicles can move again. After the first section is liberated the second section gets the right to go and so on until the last section gets liberated ending the traffic congestion (FIGS. 2 and 3, refer to the points by the signals).

The invention claimed is:

1. A process to resolve traffic congestions and reduce the unwanted side effects of these such as increased use of fuel, pollution emission, increase incidence of accidents, driving stress, reduction of national economic losses and unfavourable relationships between drivers and traffic authorities by replacing the "stop and go" driving behaviour with "stop and wait, then go later without stopping" driving behaviour using a sensors-signals-communication system, said process consisting in:

a. installing various stop and go signals, the sensors and the whole communication system for the automatic operation of the process in an area with tendency to traffic congestion problems, b. identifying via human or automatic analysis of the traffic flow, the formation of a possible traffic congestion, determining a "congestion head" this is defined as the location where the first vehicles have been detected in a standstill position and/or in "stop and go" behaviour and declaring the area from this position as "conflict area";

c. having the area been divided from the congestion head in the opposite direction of the traffic into segments limited by the stop (and go) signals;

d. activating the first stop signal which determines the congestion head forcing the vehicles to a standstill one after the other waiting for the detachment of the conflict area ahead, and allowing stopped drivers to turn off the engine during this waiting time with the following vehicles filling all the segments under each signal successively, waiting for the liberation of the front conflict area;

e. activating successively the second, third, fourth etc stop signal after the filling up of every corresponding front segment;

f. beginning with the front stop signal been turn to "go" the liberation of the front conflict area allowing the start of the vehicles which are waiting in this front segment and its detachment;

g. turning the corresponding next signal to "go" allows the successive liberation of the corresponding front segments and the vehicles successively progressing one after the other to adopt the "go later without stopping" driving behaviour resulting in the reduced occurrence of unwanted side effects of "stop and go";

h. repeating points "b" to "h" until the congestion has disappeared.

2. The process as set forth in claim 1 wherein the said process includes time indicators placed on the corresponding stop and go signals indicating to the drivers the estimated waiting time from every segment thereby avoiding lack of concentration on the road and uncertainty of waiting time of the drivers.

* * * * *